US005429371A

United States Patent [19]

Bledsoe

[11] Patent Number: 5,429,371

[45] Date of Patent: Jul. 4, 1995

[54] WORD BASED BOARD GAME

[76] Inventor: Michael A. Bledsoe, P.O. Box 134, Paola, Kans. 66071

[21] Appl. No.: 123,754

[22] Filed: Sep. 17, 1993

[51] Int. Cl.[6] ..... A63F 3/00

[52] U.S. Cl. ..... 273/272; 273/243

[58] Field of Search ..... 273/240, 243, 272, 299

[56] References Cited

U.S. PATENT DOCUMENTS

| | | | |
|---|---|---|---|
| 3,396,972 | 8/1968 | Smith . | |
| 4,055,347 | 10/1977 | Kreischer . | |
| 4,171,815 | 10/1979 | Sturtz . | |
| 4,252,323 | 2/1981 | Levinrad | 273/272 |
| 4,306,724 | 12/1981 | Brzezinski et al. . | |
| 4,340,231 | 7/1982 | Cammarata . | |
| 4,741,538 | 5/1988 | Lewis . | |
| 4,850,595 | 7/1989 | Sherman et al. | 273/272 |
| 4,900,031 | 2/1990 | Wohl . | |
| 4,907,807 | 3/1990 | Lee et al. . | |

*Primary Examiner*—Vincent Millin

*Assistant Examiner*—William M. Pierce

*Attorney, Agent, or Firm*—Stinson, Mag & Fizzell

[57] ABSTRACT

A board game has first and second playing areas, with the first playing area being a continuous path along the perimeter of the game board. The second playing area is located within the first playing area and includes spaces for forming words with the spaces having a surface for erasable markings of letters. The first and second playing areas have indicia printed thereon. The first playing area determines which letters to use to form words within the second playing area, and indicates the monetary values for using the indicated letters. The board game also includes a die that controls the movement of player pieces along the continuous path and which directs the players to use a spinner of the board game. Words may be formed within the second playing area and can be spelled forward, backward, vertically, horizontally or diagonally. The spinner provides a further random chance control.

24 Claims, 6 Drawing Sheets

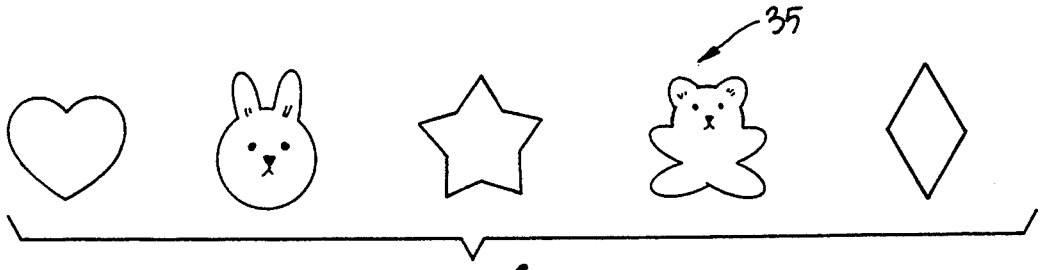
Fig. 2
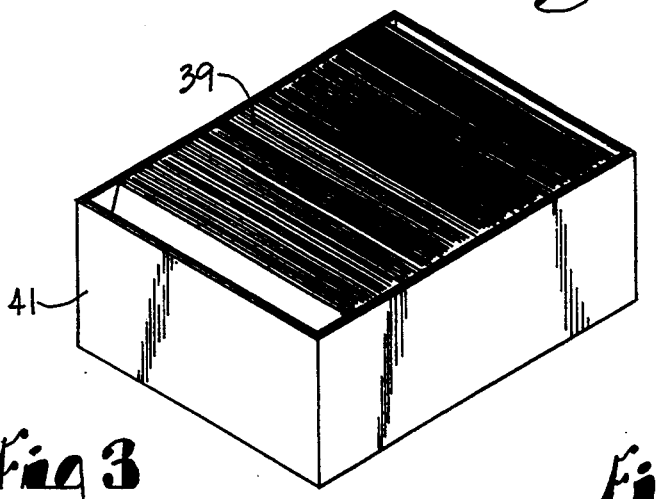
Fig 3
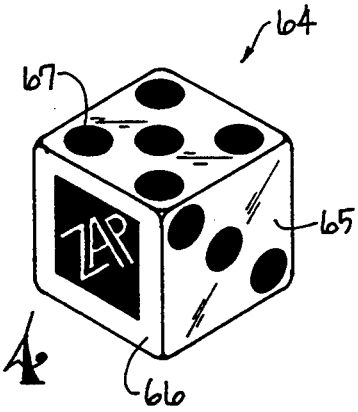
Fig. 4
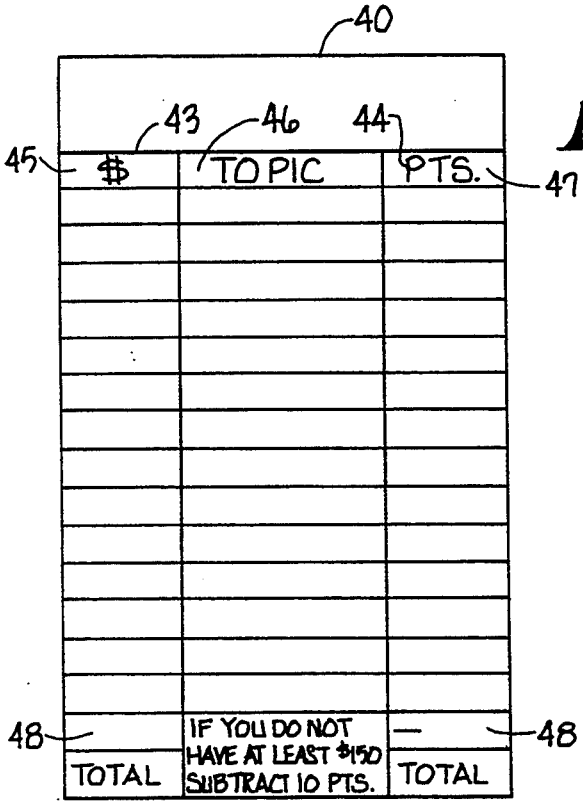
Fig. 5
Fig. 6
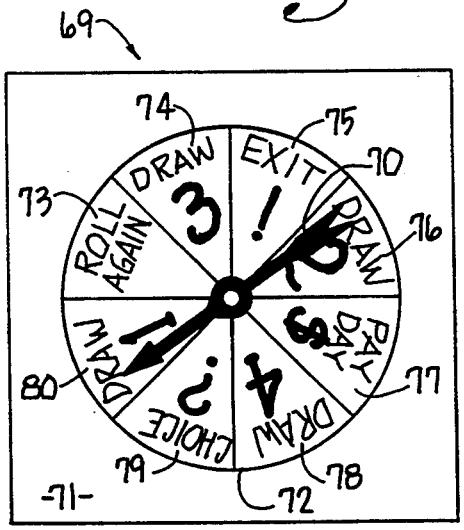

WORD BASED BOARD GAME

FIELD OF THE INVENTION

The present invention generally relates to word games and more particularly to a game apparatus for a board game wherein letters are used to form words.

BACKGROUND OF THE INVENTION

There are a number of word games available wherein play money is used along with a set of dice or a spinner to form words within a board game. These prior art games have provided entertainment and educational experiences. The present invention, however, is concerned with improving upon these prior art board games by including limitations and other features which foster mental exercises in forming words within distinct topic categories.

Lee et al. U.S. Pat. No. 4,907,807 discloses a board game for playing crossword puzzles having a first continuous playing path lying adjacent to the outer edges of the board, with a second continuous playing path directly adjacent to the first. The remaining area inside the board includes a playing surface in the format of a crossword puzzle. Words are formed within the larger remaining area inside the continuous playing paths by rolling a die to determine whether the word to be played on the crossword puzzle shall be across or downward. Once a word is formed within the crossword puzzle in a square, the player must guess a word from clues provided by a set of playing cards. Correctly guessing the word allows a player to attempt to add an additional word on the inner crossword puzzle area. Although this board game utilizes a combination of a set of dice and playing cards, it does not include the use of a spinner and is limited to the use of playing cards with clues of a crossword puzzle variety that restrict the choice of words to be formed.

The Wohl U.S. Pat. No. 4,900,031 discloses a board game with two sets of cards for determining the name of a famous person having the initials on the drawing cards. The Wohl '031 patent does not have a common word forming board within a continuous playing path.

There are other board games which utilize multiple board spaces and involve word formation. Exemplary of such games include the method of playing a word forming game of the Lewis U.S. Pat. No. 4,741,538, the random selection word game of the Cammarata U.S. Pat. No. 4,340,231, the word forming game of the Sturtz U.S. Patent No. 4,171,815, the board game apparatus of the Brzezinski et al. U.S. Pat. No. 4,306,724, the board game apparatus of the Kreischer U.S. Pat. No. 4,055,347 and the word construction game of the Smith U.S. Pat. No. 3,396,972. Although these last-mentioned games are entertaining and interesting, they do not improve and enhance the players' vocabulary skills to the extent that the word formation board game of the present invention does.

For example, the board game apparatus of the Brzezinski et al. '724 patent discloses a word formation game having an outer continuous path and an inner area for the formation of words. The outer continuous path includes spaces for category, penalty and bonus cards. Further, the outer continuous path has a spinner mounted thereto which provides a random control choice. A throw of dice controls the movement of a player piece along the outer continuous path. The game also includes a timing device and a set of dice. The formation of the words are determined by the categories provided by the category cards and includes limitations such as the use of penalty cards, the restriction that words formed must incorporate at least one letter of a previously formed word, and the inability to form words without the use of tiles.

Accordingly, it is considered desirable to have a board game apparatus having a playing area with a surface for erasable marking of letters, such that the letters can be entered onto spaces and then wiped away after the game is over; a surface where word tiles and player identification pieces can be removably stuck to the surface and then later removed when the game is over, a die having the term "ZAP" printed on one side of the die directing the player to spin a spinning device and to follow the instructions provided by the spinning device, and the ability to form words in the inner playing area by placing the letters forward, backward, vertically, horizontally or diagonally.

SUMMARY OF THE INVENTION

The present invention is a board game apparatus that includes first and second playing areas with the first playing area having a continuous path along the perimeter of the board and the second playing area located within the first playing area. The first and second playing areas have an erasable surface for marking letters. Letters and game pieces on the surface are removably stuck to the playing surface until later removed. The board game apparatus includes random choice controls such a die and a spinner, the die having six sides with sides two through six indicating the numbers two through six and side one having a colored square with the phrase "ZAP" located inside the square. The spinning device has an arrow indicator and a surface with eight pie-shaped sections providing directions for the players. The game apparatus also includes first and second sets of cards, the first set of cards being scorecards and the second set of cards indicating which square of the second playing area should be covered by solid tiles, preventing letters to be placed on these squares unless a player purchases a right to remove the colored tile from the square.

The present invention adds a dimension not found in the above listed prior art by providing the ability to play a word forming game without the requirement of tiles having printed letters and using a surface for removable stickers. Two random choice controls are used to provide directions to the players and to control movement of the game pieces. The present game is simpler than most of the above-described prior art because words from different topics may be formed if a player using one of the random choice controls is directed to do so. Further, words may be formed in any direction and do not have to include a letter from a previously formed word.

OBJECTS OF THE INVENTION

Accordingly, it is an object of the present invention to provide a game apparatus which includes first and second playing areas having a surface for erasable markings of letters and the ability to removably place stickers thereon; to provide such a game apparatus which includes a plurality of movable game pieces including first and second tiles and identification game pieces for the players; to provide such a game apparatus having first tiles with letters printed thereon and second tiles being solid in color; to provide such a game apparatus with a plurality of random chance controls including a die and a spinner, a die having six sides with sides two through six having dots indicating the numbers two through six and side one having a colored square with the term "ZAP" located inside the square; to provide such a game apparatus with a spinning device having sections providing directions to the players; to provide such a game apparatus with a plurality of sets of cards including a first set and second set, the first set of cards indicating to a player which square on the second playing area should be covered by the solid color tiles and the second set of cards being score keeping cards; to provide such a game apparatus wherein the players can purchase with earned money the ability to place second tiles on the spaces of the second playing area which have not been previously used to form words; to provide such a game apparatus wherein words may be formed by using a letter of previously formed words and where players may purchase with earned money the ability to form a word without using a letter of a previously formed word; to provide such a game apparatus where players may form words without using a letter of a previously formed word by deducting an amount of earned money from the player's scorecard; and to provide a game apparatus where players accumulate at least one point for each letter of a word formed on the spaces of the second playing area.

Other objects and advantages of the present invention will be apparent from the following description, drawings and appended claims.

BRIEF DESCRIPTION OF THE DRAWINGS

FIG. 2 is a plan view of player identification game pieces.

FIG. 3 is a perspective view of the draw cards.

FIG. 4 is a perspective view of the die to the board game.

FIG. 5 is a plan view of a scorecard.

FIG. 6 is a plan view of the spinner to the board game.

DETAILED DESCRIPTION

Figure 1A:
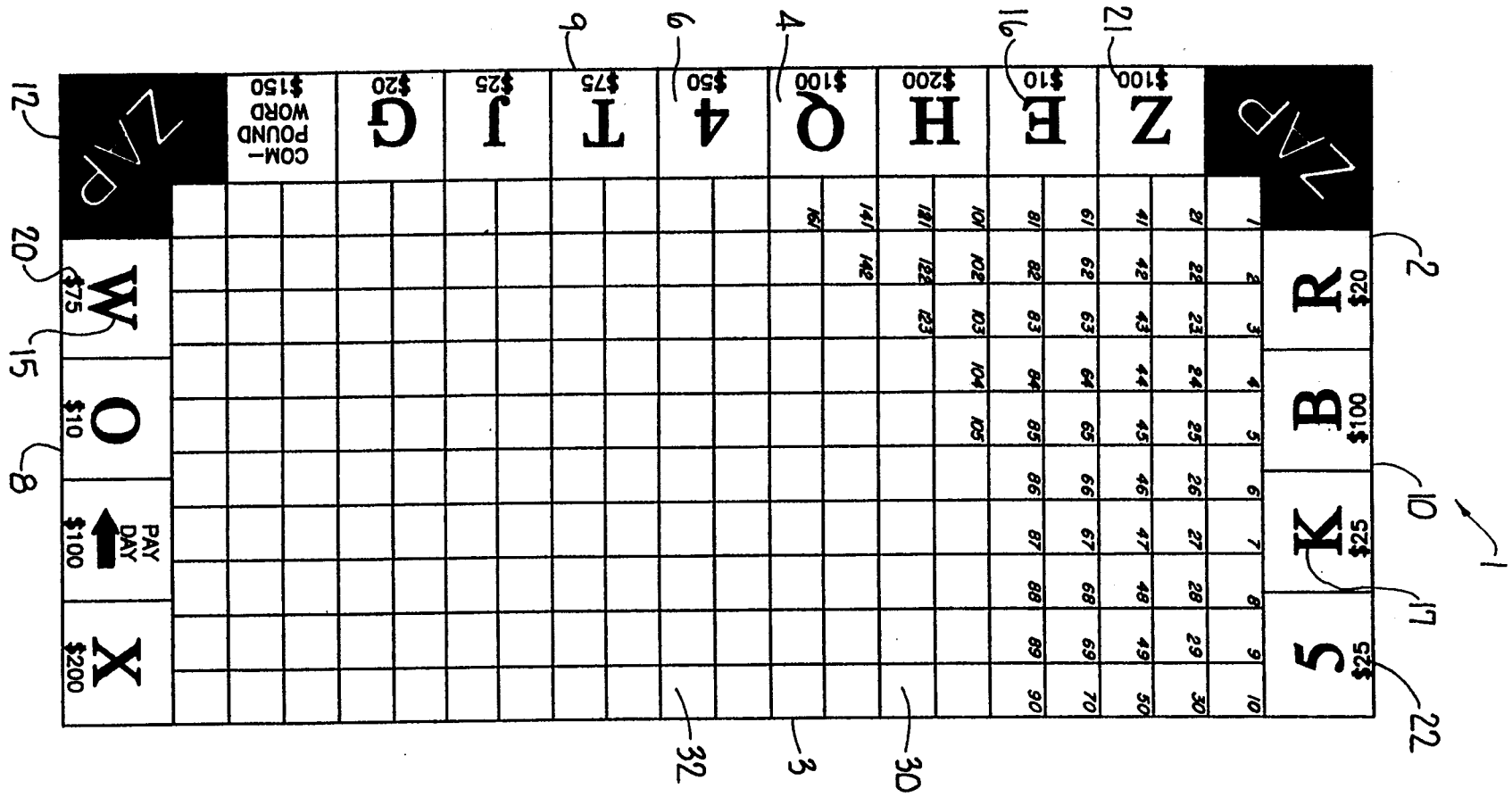
FIGS. 1A and 1B combined are a plan view of a word based board game.
Figure 1B:
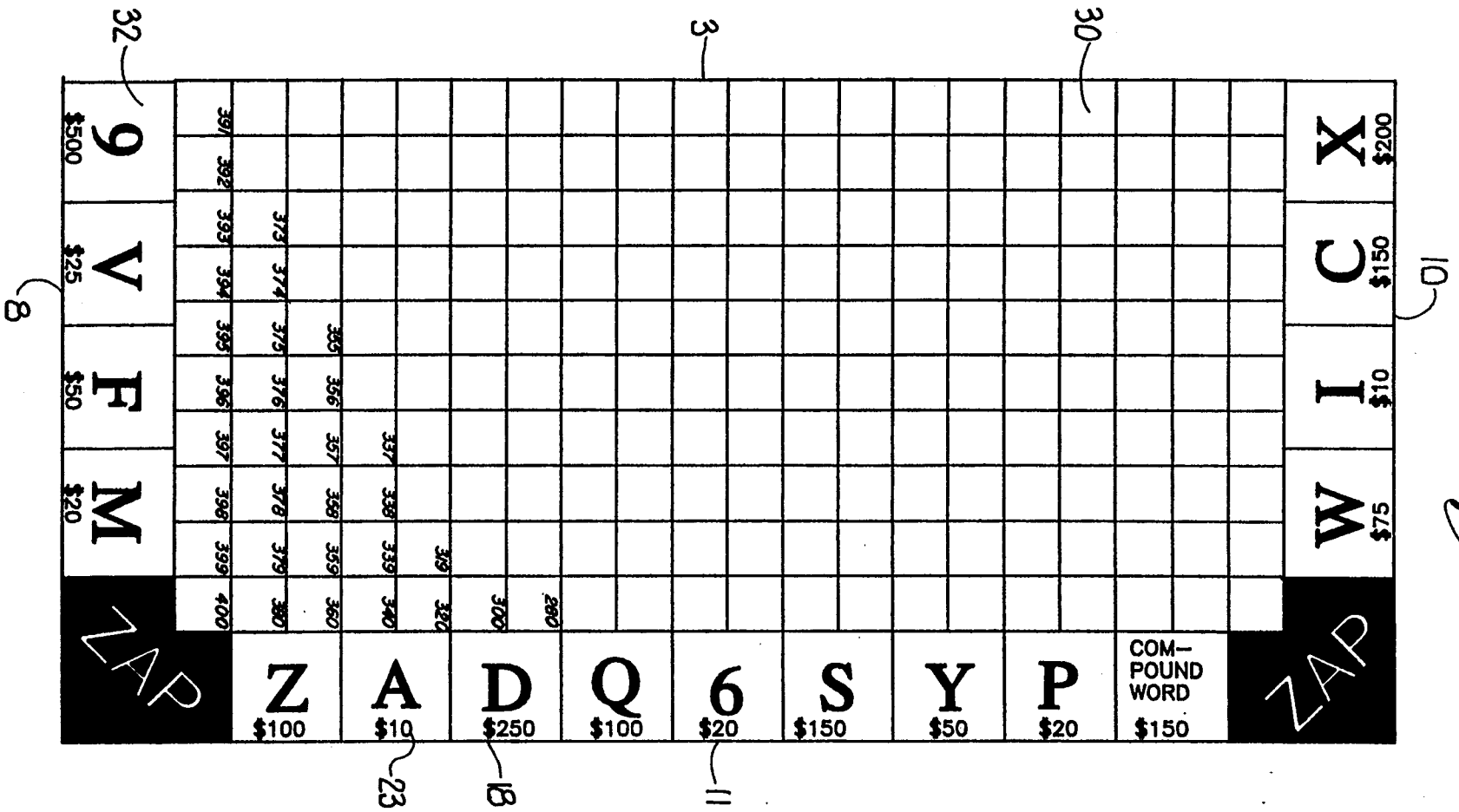

FIGS. 1A and 1B illustrate the game board 1 that is to be constructed of a material which is sufficiently rigid with the movement and placement of game pieces thereon. The game board 1 has first and second playing areas, 2 and 3, respectively.

The first playing area 2 has a continuous path 4 located along the outer perimeter of the game board 1 and is divided into thirty-eight spaces 6. The path 4 includes first, second, third and fourth sides, 8–11 respectively, and corners 12. The spaces 6 have markings with dollar values printed thereon.

The first side 8 includes markings 15 with respective dollar values 20. The markings 15 are colored such that they differ in color. The dollar values 20 are printed below the markings 15. The markings 15 include different letters, a number and an arrow indicating the space of "PAY DAY". The markings 15 are arranged in the following order: "M", "F", "V", "9", "X", the pay day arrow, and the letters "O" and "W", and have the following respective dollar values 20: 20, 50, 25, 500, 200, 100, 10 and 75. The corners 12, which separate the four respective sides, include the word "ZAP", which are printed in different colors over a dark background.

The second side 9 includes spaces 6 having markings 16 with respective dollar values 21 printed thereon. The markings 16 include the term "COMPOUND WORD", the letters "G", "J", "T", the number "4" and the letters "Q", "H", "E" and "Z", and have the following dollar values 21 in the respective order: 150, 20, 25, 75, 50, 100, 200, 10 and 100. The third side 10 has spaces 6 with the markings 17 and dollar values 22 printed thereon. The markings 17 include the letters "R", "B", "K", the number "5", the letters "X", "C", "I" and "W" and have the following dollar values 22 in their respective order: 20, 100, 25, 25, 200, 150, 10 and 75. The fourth side 11 has spaces 6 with the markings 18 and the dollar values 23 printed thereon. The markings 18 include the term "COMPOUND WORD", the letters "P", "Y", "S", the number "6" and the letters "Q", "D", "A" and "Z", with the following dollar values 23 in the respective order: 150, 20, 50, 150, 20, 100, 250, 10 and 100.

Figure 7:
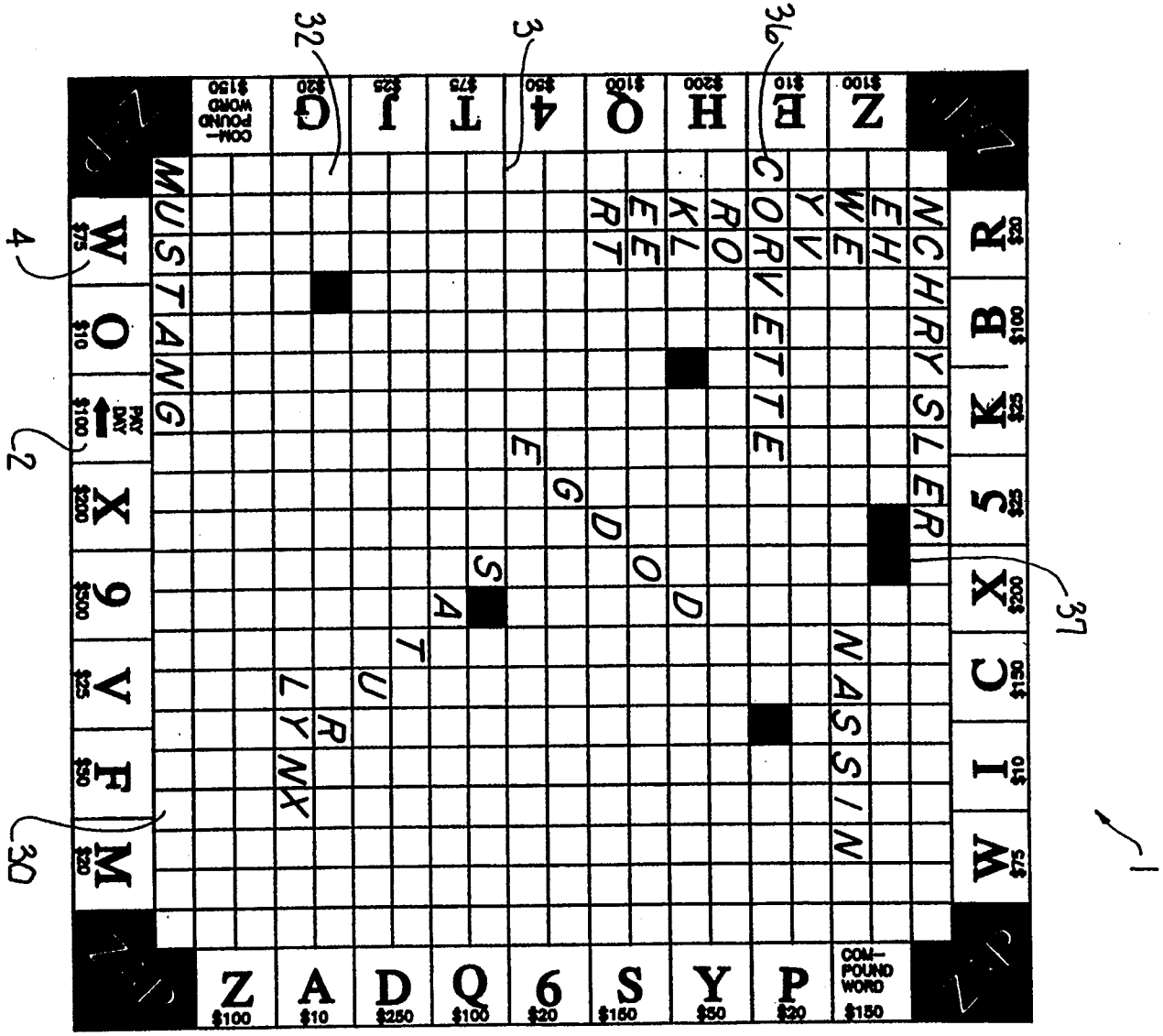
FIG. 7 is a plan view of the board game with an example of how a game might proceed when playing the version "WURDZ" with cars as a topic.
Figure 8:
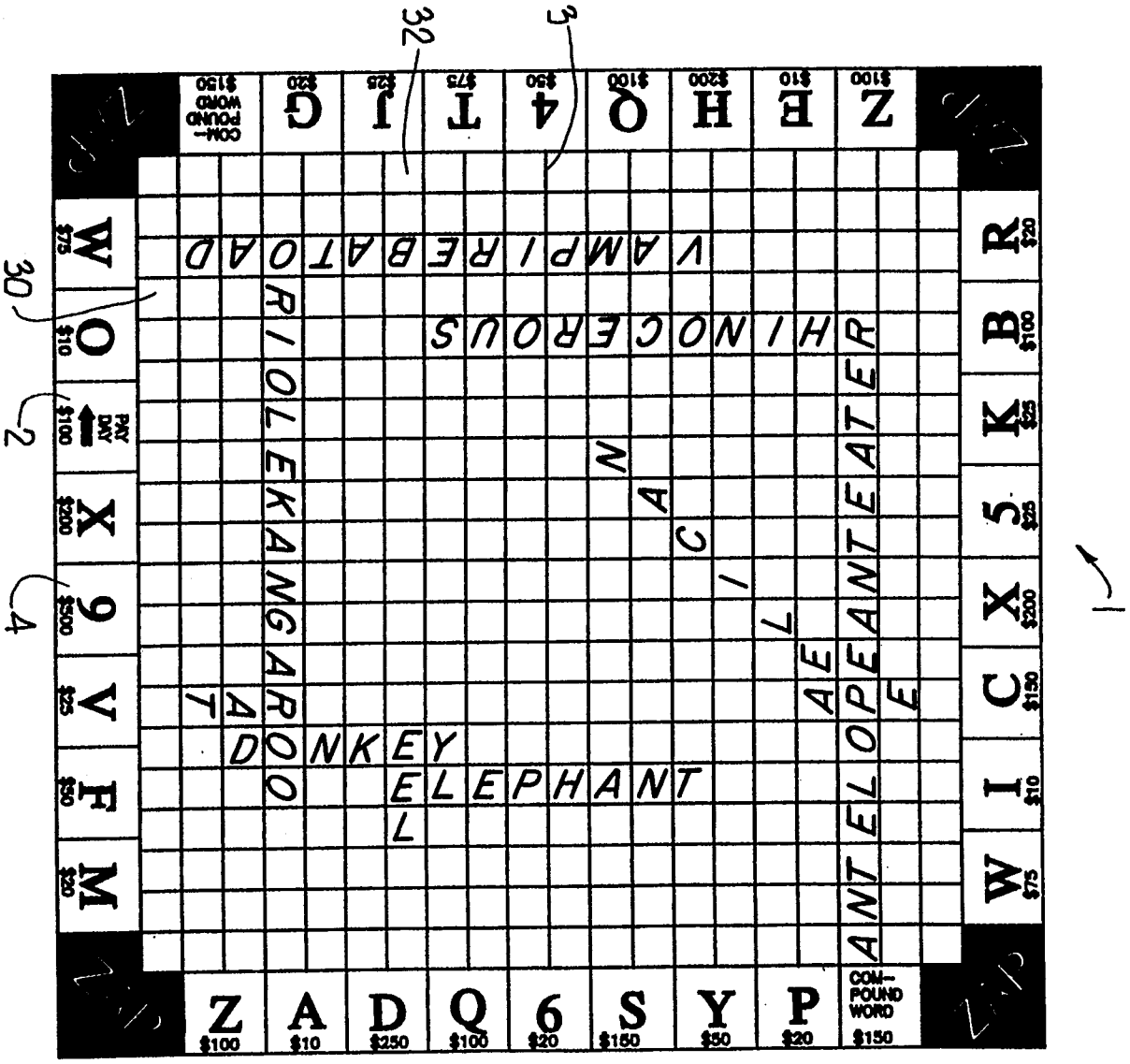
FIG. 8 is a plan view of the board game with an example of how a game might proceed when playing the version "WURDZ WOR" with animals as a topic.
Figure 9:
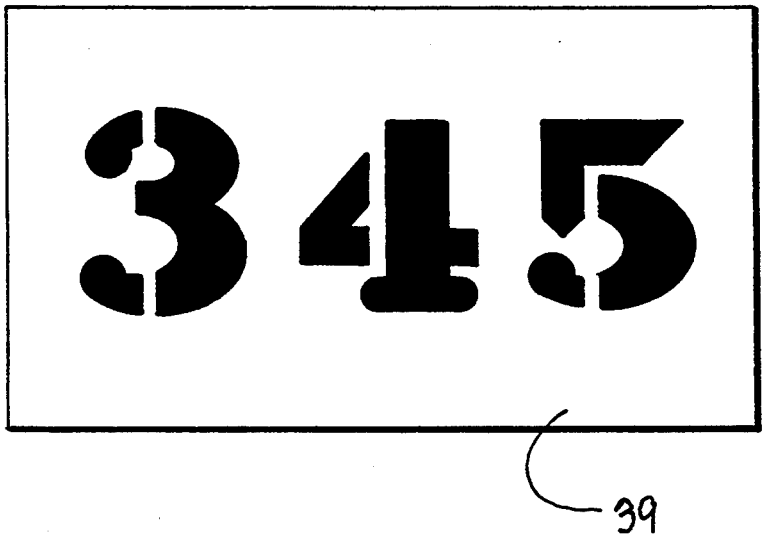
FIG. 9 is a card from the first set of cards with numbers printed thereon.

The second playing area 3 is divided into four hundred squares 30 that are arranged in a grid of twenty squares by twenty squares. The squares 30 have the numbers one through four hundred printed thereon in consecutive order. The first and second playing areas 2 and 3 have a surface 32 that is coated with a vinyl or similar smooth material, such that game pieces can be removably mounted and attached to the surface 32. As best seen in FIGS. 2, 7 and 8, the game pieces include player identification pieces 35 and square shaped first and second tiles 36 and 37. The first tiles 36 have letters printed thereon, and the second tiles 37 are solid in color. As shown in FIG. 2, the player identification game pieces 35 can include various shapes. Referring to FIGS. 7 and 8, the first tiles 36 are used to form words on the surface 32 of the second playing area 3.

Referring to FIGS. 3 and 5, the game board 1 also includes first and second sets of cards 39 and 40. The first set of cards 39 has numbers printed thereon that correspond to the numbers printed on the squares 30 of the second playing area 3. The first set of cards 39 are maintained in a card storage box 41.

As best seen in FIG. 5, the second set of cards 40 are scorecards that have three columns 43 with headings 44. The first column 45 allows a player to keep track of the total dollar value for a word formed on the second playing area 3. The second column 46 allows a player to note the words that are formed from a chosen topic, and which are formed in the second playing area 3 through the use of the first tiles 36. The third column 47 allows the player to record the number of points for each word formed in the second playing area 3. At the bottom of the second set of cards 40 are total entering lines 48 that allow the player to total the dollar values and points at the end of the game.

Referring to FIG. 4, the board game 1 also includes a die 64 having six sides 65. Side one 66 has the phrase "ZAP" printed thereon. The remaining sides 65 have markings 67 that represent the numbers two through six.

Referring to FIG. 6, the board game 1 includes a spinner 69 having a rotatable indicator 70, mounted on a surface 71 with a circle 72 printed within the center of the surface 71. The circle 72 is divided into eight separate sections. The eight sections provide a random chance control for the players of the board game. The first section 73 provides that the player should roll a die 64 again. The second section 74 provides that the player should draw three cards from the first set of cards 39. The third section 75 provides that the player for that particular turn only can exit the topic being played and choose a new topic for forming a word on the second playing area 3. The fourth section 76 provides that the player should draw two cards from the first set of cards 39. The fifth section 77 provides that the player should move his identification game piece 35 along the path 4 of the first playing area 2 to the space 6 indicting the phrase "PAY DAY" and that the player should collect the dollar value 14 of $100.00, which is printed underneath the phrase "PAY DAY". The sixth section 78 provides that the player should draw four cards from the first set of cards 39. The seventh section 79 provides that the player can move his identification game piece 35 to any space 6 along the path 4 of the first playing area 2, except for the spaces 6 indicating the phrases "PAY DAY" or "ZAP". The eighth section 80 provides that the player should draw one card from the first set of cards 39.

The arrangement and structure of the board game 1 will be more fully understood from the following description on how to play the board game.

HOW TO PLAY THE "WURDZ" BOARD GAME

The following are two versions of how to play the board game. The first version is called the "WURDZ" version, and the second is called the "WURDZ WOR" version. In the "WURDZ" version, each person receives a scorecard 40 and chooses a player identification game piece 35 which the player will use to move around the path 4 along the first playing area 2 of the game board 1. The players will choose a word topic and enter the topic in the topic heading (second column) 46 of the scorecard 40. Each person will then roll the die 64 to see who goes first. The person rolling the lowest number goes first and the others follow in a counter-clockwise direction. Any individuals who roll a tie must roll the die again. The side one 66 of the die 64 which has the term "ZAP" is equal to the value of one. All the players start at the space 6 along the path 4 that has the term "PAY DAY" printed thereon and records $100 on the scorecard 40 to start the board game. The players move their identification game piece 35 along the path 4 in a clockwise direction by the amount shown on the roll of the die 64.

When a player lands his identification game piece 35 on a space 6 having letter markings 15, 16, 17 or 18 printed thereon, the player may collect the amount of dollar value 20, 21, 22 or 23 as shown by the space 6 only if the player is able to form a word using letter tiles 36 on the second playing area 3 that begins with the letter markings 15, 16, 17 or 18 of the space 6 having the player's identification piece 35 thereon. There is a large common supply of letter tiles 36 from which the players can select the desired letter tile 36 for placement on the second playing area 3. If the player cannot form a word using the letter tiles 36 with the letter markings 15, 16, 17 or 18, the player may still form a word on the second playing area 3, but may not record any earned money on the scorecard 40. The player, however, may instead score points by counting one point for each letter of a word played on the second playing area 3. The player would record the points earned on the scorecard 40 from the word formed.

If a player were to land his identification game piece 35 on a space 6 that has a number markings 15, 16, 17 or 18 printed thereon, the player may record the dollar amount shown on the space 6 and the points indicated by the squares 30 if the player is able to form a word on the second playing area 3 that contains the particular amount of letters as indicated by the number markings 15, 16, 17 or 18. If the player, however, cannot form a word containing that amount of letters, the player may still form another word on the second playing area 3 collecting one point for each letter of the word on the second playing area 3.

If the player has his/her identification game piece 35 land on the space 6 that contains the term "COMPOUND WORD", the player may record the dollar amount indicated by the space 6 only if the word formed in the second playing area 3 is a compound word. If the player is not able to form a compound word, the player may still form another word collecting one point for each letter of the word on the second playing area 3.

If the player has his game identification piece 35 land on the space 6 that is a corner 12 having the term "ZAP" printed thereon, then the player must spin the spinner 69 and follow the directions as provided by the indicated arrow 70. Likewise, if the player rolls the die 64 and rolls side one 66 having the term "ZAP" printed thereon, the player must also spin the spinner 69 and moves his identification piece 35 ahead one space 6 along the continuous path 4 of the first playing area 2.

The first player to form a word in the second playing area 3 must form the word in the middle of the second playing area 3 and may form the word forward, backward, vertically, horizontally or diagonally. As shown in FIG. 7, once the first word is formed on the second playing area 3, each succeeding player must cross over any existing word on the game board 1 by utilizing any of the players' letter tiles 36. The players score points by counting a point for each letter of a word that is formed on the second playing area 3. If a player wishes to form a word on the second playing area 3 without crossing over an existing word on the game board 1, thus not using at least one letter already on the game board 1, then the player must deduct $100 of the earned money from the dollar (first) column 45 of the scorecard 40. The player, however, must finish the board game with at least $150 in his total entering line 48 or must subtract ten points from his final point score at the end of the board game. At the end of the board game, if there is a tie in points between two players, the player with the most money noted in the dollar (first) column 45 is the winner of the board game.

If a player lands on a corner 12 having the term "ZAP" printed thereon or rolls a "ZAP" on the die 64, the player must spin the spinner 69. If the indicating arrow 70 points to the second section 74, the fourth section 76, the sixth section 78 and the eighth section 80, then the player must draw that amount of cards from the first set of cards 39. The numbers 31 that are printed on the squares 30 within the second playing area 3 correspond to the numbers printed on the first set of cards 39. Each card of the first set of cards 39 that is drawn must have its corresponding square 30 blacked out with the solid color tiles 37. These squares 30 are now unable to be used to form a word, unless a player pays $500 to be able to use the blocked off square 30. The player wishing to pay $500 would subtract this amount of money from his scorecard 40. The player must then use the space 30 which has just been purchased.

If the indicating arrow 70 points to the first section 73, the player must roll the die 64 again and continue playing. If the indicating arrow 70 points to the third section 75, the player may exit the existing topic chosen at the beginning of the game for this play only, and play any word from any topic or category of his/her choice. The player must return to playing the original topic on his next turn. If the player cannot utilize this opportunity, the player must pass it to the next player in consecutive order. If the indicating arrow 70 points toward the seventh section 79, the player must move his/her player identification game piece 35 to any space 6 along the path 4 other than a corner 12 or a space 6 having the term "PAY DAY" thereon. The player cannot occupy the space 6 which the player's game piece 35 is currently thereon. The player must utilize the marking 15, 16, 17 or 18 that is provided by the new space 6 which he/she has moved his/her game piece 35 to and does not have the option to play or form any other word that does not utilize the provided marking 15, 16, 17 or 18 correctly, unless all remaining players agree that there is no other possibility. If another player, however, can utilize the player's "choice" spin opportunity, the player must pass the turn to the next player.

In playing the board game, a word can only be formed once. If a word that has been played on the second playing area 3 is also the root of a second word, then that second word may be played. For example, if a first player were to play the word "blue" under the topic "colors", then a second player could play the word "blue-green". The board game is over when the players have reached the amount of turns originally decided upon or when every player passes his turn to the next player and no one can play a valid word. The board game can also be used with a time limiting device, such as a stop watch, to limit the time that a player may use to form a word. If the player cannot form a word within the limited time, the player must pass his turn to the next player.

HOW TO PLAY THE "WURDZ WOR" BOARD GAME

The second version of the board game is the "WURDZ WOR" version. In this version, the scorecards 40 are passed out, a topic is chosen and the players roll a die 64 to determine who will go first, just as in the original "WURDZ" version. The "WURDZ WOR" version, however, is limited to two to four players. If there are only two players, then the players must play opposite each other. The players can only form words on the second playing area 3 which the player is able to read from the player's respective position to the game board 1. As seen in FIG. 8, an example of how a game might proceed is shown with animals as a topic. The only letter which may be utilized to cross any other player's word is the letter "O", which shall be considered universal due to its ability to play the same from any direction on the board. The players are able to form words anywhere on the second playing area 3 and are required to cross over their own existing words after they have entered the first word on the game board 1, or utilize and cross over the letter "O" of another player's word since the letter "O" is universal. When a player spins the spinner 69 and the indicating arrow 70 indicates that the player should draw a card from the first set of cards 39, the player does not draw any cards but instead places the required number of solid color tiles 37 anywhere along the second playing area 3. The cost for removing a solid color tile 37 is $250, which must be subtracted from the player's scorecard 40. The players must finish the game with at least $75 in the total entering lines 48 of the scorecard 40. In the case of a tie, the player with the most money wins.

It is to be understood that while certain forms of this invention have been illustrated and described, the invention is not limited thereto except insofar as limitations are included in the following claims.

What is claimed and desired to be secured by Letters Patent is as follows:

1. A game apparatus comprising:

(a) a game board having first and second playing areas and four outer edges, said first playing area having a continuous path adjacent to said outer edges of said board, said second playing area located within said first playing area, said first and second playing areas having a plurality of spaces having indicia printed thereon;

(b) a plurality of movable game pieces;

(c) a plurality of random chance controls including a die and a spinner;

(d) a first and second set of cards, said first cards having an indicia means printed thereon that correspond to said indicia printed on said second playing area for indicating said indicia for said second playing area to determine which said spaces of said second playing area should be covered by said game pieces, said second cards having a means for keeping score for players of said game apparatus and a means for recording a topic chosen and any words formed by said players; and (e) said second cards having an area for indicating a total dollar value for each word formed by each said player.

2. A game apparatus as set forth in claim 1 wherein said game pieces include first tiles having letters printed thereon, second tiles containing no indicia and identification pieces for said players, said indicia means on said first cards includes a first set of numbers.

3. A game apparatus as set forth in claim 2 wherein said spaces of said first playing area are for accommodating placement of said identification pieces, and spaces of said second playing area are for accommodating placement of said first and second tiles, said indicia of said spaces of said second playing area has a second set of numbers printed thereon that correspond to said first set of numbers of said first cards, said player being able to obtain a point for each said first tile used when words are formed on said second playing area, said indicia of spaces of said first playing area includes first spaces with letters and numbers, second spaces with instructions to form compound words and third spaces with the word "ZAP" printed thereon.

4. A game apparatus as set forth in claim 1 wherein said spinner has an indicator and a plurality of sections arranged in a ring about said indicator, said sections of said spinner comprising:

(a) a first section indicating that said player can roll said die again;

(b) a second section indicating said player can draw three cards from a first set of cards;

(c) a third section indicating said player can choose a new topic for forming a word;

(d) a fourth section indicating said player can draw two cards from said first set of cards;

(e) a fifth section indicating where said player should move player's identification game piece along said first playing area to said space indicating "PAY DAY" and that said player should collect the indicated amount of said money;

(f) a sixth section indicating said player should draw four cards from said first set of cards;

(g) a seventh section indicating said player can move said identification game piece to any location on said first playing area other than said spaces indicating "PAY DAY" or "ZAP"; and (h) an eighth section indicating said player can draw one card from said first set of cards.

5. A game apparatus as set forth in claim 1 wherein said die has six sides, said sides two through six having dots indicating the numbers two through six, said side one having a colored square with the word "ZAP" located inside said square, said word "ZAP" being of a different color from said square of said side one, and said spinner comprising a surface with a rotatable indicator mounted in the center of said surface and a plurality of sections arranged in a ring about said indicator.

6. A game apparatus as set forth in claim 1, wherein said game includes erasable markers for writing letters on said spaces of said second playing area that have not been used to form words.

7. A game apparatus as set forth in claim 1, wherein said second playing area includes rows and columns of said spaces for forming arrangement of respective said first tiles in one of a row and column to form a word by said player, said second playing area defines a square grid of said spaces arranged by said columns and said rows.

8. A game apparatus as set forth in claim 7, wherein said spaces of said second playing area have a surface having means for erasable marking of letters such that said letters can be entered onto said spaces and then wiped away after said game is over.

9. A game apparatus as set forth in claim 7, wherein said first and said second tiles have means for sticking to the surface of said spaces of said second playing area and for easy removal therefrom.

10. A game apparatus comprising:

(a) a game board having first and second playing areas and four outer edges, said first playing area having a continuous path adjacent to said outer edges of said board, said second playing area located within said first playing area, said first playing area having a plurality of spaces for accommodating placement of identification game pieces for players of said game apparatus, said second playing area including spaces for forming words having a surface having means for erasable marking of letters such that said letters can be entered onto said spaces and then wiped away after said game is over, said spaces of said first and second playing areas having indicia printed thereon;

(b) a plurality of movable game pieces including first and second tiles and identification game pieces, said first tiles having letters printed thereon, said second tiles containing no indicia and said first and second tiles having means for placement in their said spaces of said second playing area;

(c) a plurality of random chance controls including a die and a spinner, said die having six sides with sides two through six having dots indicating the numbers two through six, and side one having a colored square with the word "ZAP" located inside said square, said word of said side one of said die being of a different color from said square, said spinner comprising a surface with a rotatable indicator mounted in the center of said surface and a plurality of sections arranged in a ring about said indicator, said sections of said spinner comprising:

(i) a first section indicating said player should roll said die again;

(ii) a second section indicating said player can draw three cards from the first set of cards;

(iii) a third section indicating said player can choose a new topic for forming a word;

(iv) a fourth section indicating said player can draw two cards from said first set of cards;

(v) a fifth section indicating where said player should move said identification piece along said first playing area to said space indicating "PAY DAY" and said player should record the indicated amount of money;

(vi) a sixth section indicating said player should draw four cards from said first set of cards;

(vii) a seventh section indicating said player can move said identification game piece to any location on said first playing area other than said spaces indicating "PAY DAY" or "ZAP"; and (viii) an eighth section indicating said player can draw one card said first set of cards; and (d) a first and a second set of cards, said first cards having an indicia means printed thereon that correspond to said indicia printed on said second playing area for indicating said indicia for said second playing area to determine which said spaces of said second playing area should be covered by said first and second tiles, said second cards having a means for keeping score for said players and a means for recording a word topic and any words formed by said players, said second cards having an area for indicating a total dollar value for each word formed by each said player.

11. A game apparatus as set forth in claim 10, wherein said indicia means of said first cards includes a first set of numbers, said indicia of said second playing area has a second set of numbers printed thereon that correspond to said first set of numbers of said first cards, and said indicia of said first playing area has letters, a third set of numbers and instructions, said indicia of said first playing area includes first spaces with said letters and said third set of numbers, second spaces with said instructions and third spaces with the word "ZAP" printed thereon.

12. A game apparatus as set forth in claim 10, wherein said second tiles have means for sticking to the surface of said second playing area and for easy removal therefrom.

13. A game apparatus as set forth in claim 10, wherein said second playing area includes rows and columns of said spaces for forming arrangement of respective said first tiles in one of a row and column to form a word by said player, said second playing area defines a square grid of spaces arranged by said columns and said rows.

14. A game apparatus comprising:

(a) a game board having first and second playing areas and four outer edges, said first playing area having a continuous path adjacent to said outer edges of said board, said second playing area located within said first playing area, said first and second playing areas having a plurality of spaces having indicia printed thereon, said indicia on said second playing area including a first set of numbers, said indicia on said spaces of said first playing area including first spaces with letters and a second set of numbers, second spaces with instructions to form compound words and third spaces with the word "ZAP" printed thereon;

(b) a plurality of movable game pieces, said game pieces including first tiles having letters printed thereon, second tiles containing no indicia and identification pieces for said players, said spaces of said first playing area are for accommodating placement of said identification pieces, said spaces of said second playing area are for accommodating placement of said first and second tiles;

(c) a plurality of random chance controls including a die and a spinner; and (d) a first and second set of cards, said first cards having an indicia means printed thereon, said indicia means on said first cards including a third set of numbers that correspond to said first set of numbers printed on said second playing area for indicating said indicia for said second playing area to determine which said spaces of said second playing area should be covered by said first and second tiles, said second cards having a means for keeping score for players of said game apparatus and a means for recording a topic chosen and any words formed by said players, said second cards having an area for indicating a total dollar value for each word formed by each said player.

15. A game apparatus as set forth in claim 14, wherein said die has six sides, said sides two through six having dots indicating the numbers two through six, said side one has a colored square with the word "ZAP" located inside said square, said word of said side one of said die being of a different color from said colored square, said spinner has an indicator and a plurality of sections arranged in a ring about said indicator, said sections of said spinner comprising:

(a) a first section indicating that said player can roll said die again;

(b) a second section indicating said player can draw three cards from a first set of cards;

(c) a third section indicating said player can choose a new topic for forming a word;

(d) a fourth section indicating said player can draw two cards from said first set of cards;

(e) a fifth section indicating where said player can move player's identification game piece along said first playing area to said space indicating "PAY DAY" and that said player can collect the indicated amount of said money;

(f) a sixth section indicating said player can draw four cards from said first set of cards;

(g) a seventh section indicating said player can move said identification game piece to any location on said first playing area other than said spaces indicating "PAY DAY" or "ZAP"; and (h) an eighth section indicating said player can draw one card from said first set of cards.

16. A game apparatus as set forth in claim 14 wherein said game includes erasable markers for writing letters on said spaces of said second playing area that have not been used to form words.

17. A game apparatus as set forth in claim 14 wherein said second playing area includes rows and columns of said spaces for forming arrangement of respective said first tiles in one of a row and column to form a word by said player, said second playing area defines a square grid of said spaces arranged by said columns and said rows.

18. A game apparatus as set forth in claim 17 wherein said spaces of said second playing area have a surface having means for erasable marking of letters such that said letters can be entered onto said spaces and then wiped away after said game is over.

19. A game apparatus as set forth in claim 17 wherein said first and second tiles have means for sticking to the surface of said spaces of said second playing area and for easy removal therefrom.

20. A game apparatus comprising:

(a) a game board having first and second playing areas and four outer edges, said first playing area having a continuous path adjacent to said outer edges of said board, said second playing area located within said first playing area, said first and second playing areas having a plurality of spaces having indicia printed thereon, said indicia on said second playing area including a first set of numbers, said indicia on said spaces of said first playing area including first spaces with letters and a second set of numbers, second spaces with instructions to form compound words and third spaces with the word "ZAP" printed thereon;

(b) a plurality of movable game pieces, said game pieces including first tiles having letters printed thereon, second tiles containing no indicia and identification pieces for said players, said spaces of said first playing area are for accommodating placement of said identification pieces and said spaces of said second playing area are for accommodating placement of said first and second tiles;

(c) a plurality of random chance controls including a die and a spinner, said die having six sides, said sides two through six having dots indicating the numbers two through six, said side one having a colored square with the word "ZAP" located inside said square, said spinner having an indicator and a plurality of sections arranged in a ring about said indicator, said sections of said spinner comprising:

(i) a first section indicating that said player can roll said die again;

(ii) a second section indicating said player can draw three cards from a first set of cards;

(iii) a third section indicating said player can choose a new topic for forming a word;

(iv) a fourth section indicating said player can draw two cards from said first set of cards;

(v) a fifth section indicating where said player can move player's identification game piece along said first playing area to said space indicating "PAY DAY" and that said player can collect the indicated amount of said money;

(vi) a sixth section indicating said player can draw four cards from said first set of cards;

(vii) a seventh section indicating said player can move said identification game piece to any location on said first playing area other than said spaces indicating "PAY DAY" or "ZAP"; and (viii) an eighth section indicating said player can draw one card from said first set of cards; and (d) a first and second set of cards, said first cards having an indicia means printed thereon, said indicia means on said first cards including a third set of numbers that correspond to said first set of numbers printed on said second playing area for indicating said indicia for said second playing area to determine which said spaces of said second playing area should be covered by said first and second tiles, said second cards having a means for keeping score for players of said game apparatus and a means for recording a topic chosen and any words formed by said players, said second cards having an area for indicating a total dollar value for each word formed by each said player.

21. A game apparatus as set forth in claim 20 wherein said second tiles have means for sticking to the surface of said second playing area and for easy removal thereof.

22. A game apparatus as set forth in claim 20 wherein said second playing area includes rows and columns of said spaces for forming arrangement of respective said first tiles in one of a row and column to form a word by said player, said second playing area defines a square grid of said spaces by said columns and said rows.

23. A game apparatus as set forth in claim 20 wherein said game includes erasable markers for writing letters on said spaces of said second playing area that have not been used to form words, said spaces of said second playing area have a surface that can be easily cleaned by wiping away said letters written by said erasable markers.

24. A game apparatus comprising:

(a) a game board having first and second playing areas and four outer edges, said first playing area having a continuous path adjacent to said outer edges of said board, said second playing area located within said first playing area, said first and second playing areas having a plurality of spaces having indicia printed thereon, said second playing area including rows and columns of said spaces defining a square grid of said spaces by said columns and said rows, said indicia on said second playing area including a first set of numbers, said indicia on said spaces of said first playing area including first spaces with letters and a second set of numbers, second spaces with instructions to form compound words and third spaces with the word "ZAP" printed thereon;

(b) a plurality of movable game pieces, said game pieces including first tiles having letters printed thereon, second tiles containing no indicia and identification pieces for said players, said spaces of said first playing area are for accommodating placement of said identification pieces, said spaces of said second playing area are for accommodating placement of said first and second tiles in one of a said row and column to form a word by said player, said second tiles having means for sticking to the surface of said second playing area and for easy removal thereof;

(c) a plurality of random chance controls including a die and a spinner, said die having six sides, said sides two through six having dots indicating the numbers two through six, said side one having a colored square with the word "ZAP" located inside said square, said spinner having an indicator and a plurality of sections arranged in a ring about said indicator, said sections of said spinner comprising:

(i) a first section indicating that said player can roll said die again;

(ii) a second section indicating said player can draw three cards from a first set of cards;

(iii) a third section indicating said player can choose a new topic for forming a word;

(iv) a fourth section indicating said player can draw two cards from said first set of cards;

(v) a fifth section indicating where said player can move player's identification game piece along said first playing area to said space indicating "PAY DAY" and that said player can collect the indicated amount of said money;

(vi) a sixth section indicating said player can draw four cards from said first set of cards;

(vii) a seventh section indicating said player can move said identification game piece to any location on said first playing area other than said spaces indicating "PAY DAY" or "ZAP"; and (viii) an eighth section indicating said player can draw one card from said first set of cards;

(d) a first and second set of cards, said first cards having an indicia means printed thereon, said indicia means on said first cards including a third set of numbers that correspond to said first set of numbers printed on said second playing area for indicating said indicia for said second playing area to determine which said spaces of said second playing area should be covered by said first and second tiles, said second cards having a means for keeping score for players of said game apparatus and a means for recording a topic chosen and any words formed by said players, said second cards having an area for indicating a total dollar value for each word formed by each said player; and (e) erasable markers for writing letters on said spaces of said second playing area that have not been used to form words, said spaces of said second playing area having a surface that can easily be cleaned by wiping away said letters written by said erasable markers.

* * * * *